US006380853B1

(12) United States Patent
Long et al.

(10) Patent No.: US 6,380,853 B1
(45) Date of Patent: Apr. 30, 2002

(54) CUSTOMER-SENSITIVE DISPENSER USING PROXIMITY SENSING DEVICES

(75) Inventors: Joseph D. Long, Greensboro; Paul D. Miller, Winston-Salem; Dolan F. Blalock, Kernersville, all of NC (US)

(73) Assignee: Marconi Commerce Systems Inc., Greensboro, NC (US)

( * ) Notice: Subject to any disclaimer, the term of this patent is extended or adjusted under 35 U.S.C. 154(b) by 0 days.

(21) Appl. No.: 09/028,075

(22) Filed: Feb. 23, 1998

(51) Int. Cl.[7] ..... G08B 25/00; B67D 5/06

(52) U.S. Cl. ..... 340/525; 340/5.91; 340/565; 340/691.6; 700/231; 221/2; 221/8; 141/94; 222/23

(58) Field of Search ..... 340/565, 566, 340/525, 5.91, 5.1, 691.6, 691.1, 691.3; 700/231, 235, 232; 235/381, 384; 221/2, 8; 222/23; 141/94

(56) References Cited

U.S. PATENT DOCUMENTS 4,900,906 A * 2/1990 Pusic ..... 235/381
4,951,045 A * 8/1990 Knapp et al. ..... 340/944
5,097,981 A * 3/1992 Degasperi et al. ..... 221/3
5,117,407 A * 5/1992 Vogel ..... 369/30
5,305,197 A * 4/1994 Axler et al.
5,553,296 A 9/1996 Forrest et al. ..... 395/750
5,565,658 A 10/1996 Gerpheide et al. ..... 178/19
5,596,501 A * 1/1997 Comer et al. ..... 340/825.35
5,630,357 A * 5/1997 Akiyama ..... 99/323.6

OTHER PUBLICATIONS

MicroTouch Product Catalog; Undated, admitted prior art Apr. 1998.

* cited by examiner

*Primary Examiner*—Donnie L. Crosland
(74) *Attorney, Agent, or Firm*—Withrow & Terranova PLLC

(57) ABSTRACT

The present invention provides a fuel dispenser capable of sensing the proximity or location of a customer relative to the fuel dispenser without requiring direct customer contact and controlling the display or aspects of the display accordingly to conserve energy, reduce heat generation or draw the customer's attention to the display once the customer is within a relative proximity to the fuel dispenser.

41 Claims, 5 Drawing Sheets

CUSTOMER-SENSITIVE DISPENSER USING PROXIMITY SENSING DEVICES

BACKGROUND OF THE INVENTION

The present invention relates to fuel dispensers, and, in particular, to controlling dispensers and associated audio and visual display aspects based on the relative proximity of a customer with respect to the dispenser.

In recent years, traditional fuel dispensers have evolved into elaborate point-of-sale (POS) devices having sophisticated control electronics and user interfaces with large displays and touch-pads or screens. The dispensers include various types of payment means, such as card readers, to expedite and further enhance fueling and retail ordering transactions. Nowadays, a customer is not limited to the purchase of fuel at the dispenser. More recent dispensers allow the customer to purchase services, such as car washes, and goods such as fast food or convenience store products at the dispenser. Once purchased, the customer need only to pick up the goods and services at the station store or at the outlet of a vending machine.

In order to make customer interfaces more efficient and easy to use, the fuel dispenser displays have grown larger and the menu and instruction interfaces have become more complicated. The resulting increase in size and complexity has led to significant increases in power consumption and heat buildup, primarily due to the large displays, and, in particular, the back-lighting associated with these displays. The increase in heat buildup has resulted in the need to add auxiliary cooling systems to cool the multiple displays in each fuel dispenser.

In addition to the increased power consumption and heat generation, station operators have found that many customers fail to recognize the need to interact with the customer interface to initiate dispenser operation and card authorization, even though various stickers and decals have been used to provide initial instructions, such as "press here to begin." Many customers fail to recognize or even read the information on the display and search for other "hard" buttons to initiate fueling.

Thus, there is a need to provide an advanced multimedia dispenser and control system capable of saving power, reducing heat buildup and drawing attention to the display as a customer approaches the dispenser in order to more effectively communicate to the customer that interaction with the display is necessary to operate the fuel dispenser.

SUMMARY OF THE INVENTION

The present invention fulfills the needs described above by providing a fuel dispenser capable of sensing the proximity or location of a customer relative to the fuel dispenser without requiring direct customer contact and controlling the display or aspects of the display accordingly to conserve energy, reduce heat generation or draw the customer's attention to the display once the customer is within a relative proximity to the fuel dispenser. Based on such proximity or location detection, a control system activates the display, provides select graphic or video information to the display and/or controls the back-lighting or display intensity.

Accordingly, one aspect of the present invention provides a fuel dispenser with dual-mode display control based on customer proximity. The dispenser typically includes a housing and delivery hardware for delivering fuel to a vehicle; a display associated with the housing having a first and second mode; proximity sensing electronics associated with the housing adapted to sense the proximity of a customer relative to the housing; and a control system coupled to the display and the proximity sensing electronics. The control system is adapted to operate the display in a first mode when a customer is not relatively proximate to the housing, and to operate the display in a second mode when a customer is relatively proximate to the housing.

The control system may provide a dimmer display in the first mode and a brighter display for the second mode. The first and second modes may correspond to inactive and active display states, respectively. If the display is a liquid crystal display, or like display, having back-lighting, the control system may be adapted to operate the back-lighting in a reduced level in the first mode and at an increased level in the second mode. The back-lighting may be turned completely off or reduced in some fashion to conserve energy. Reducing or eliminating backlighting during non-fueling periods helps avoid the need to add active cooling systems to the dispensers. These systems require additional energy for operation and add significant expense to the cost of manufacturing dispensers.

Alternatively, the control system may provide a first display having graphics and/or video information pertaining to periods between transactions in the first mode, and a second display pertaining to periods of transaction, especially the beginning of a transaction, in the second mode. The information displayed may be graphics information from a graphic generator associated with the control system or new video information from a video source associated with or controlled by the control system.

Another aspect of the present invention integrates the proximity sensing electronics and the display electronics wherein the display is configured to operate in a highly sensitive mode to sense customers proximate to the display in the first mode and in a less sensitive mode to provide a touch screen display in the second mode. Alternatively, the proximity sensing electronics may include one or more proximity sensors located at various points on the fuel dispenser to sense the proximity of a customer relative to the fuel dispenser. The sensors may be used to simply sense the approach and/or presence of a customer relative to the fuel dispenser or may be configured to provide signals to the control system indicative of varying degrees of relative proximity. In the latter case, the control system may be adapted to determine the approximate relative location of a customer with respect to the fuel dispenser and adjust aspects of the display accordingly. For example, the location information determined by the control system may be used to adjust the viewing angle to optimize customer viewing or may be used to change the font or point size of text appearing on the display.

Another aspect of the present invention provides a method of operating a dispenser display in two modes. The method includes the steps of (1) operating a fuel dispenser display in a first mode; (2) sensing a customer proximate a fuel dispenser; and (3) operating the fuel dispenser display in a second mode upon sensing the customer proximate the fuel dispenser.

In those embodiments having dedicated proximity sensors, any type of proximity sensing devices are acceptable. These devices include infrared sensors and radio frequency (RF) sensors, such as radar systems. When the touch screen display is used to sense proximity, a touch screen display capable of operating at various frequencies and sensitivities is preferred.

These and other aspects of the present invention will become apparent to those skilled in the art after reading the following description of the preferred embodiments when considered with the drawings.

DETAILED DESCRIPTION OF THE PREFERRED EMBODIMENTS

Figure 1:
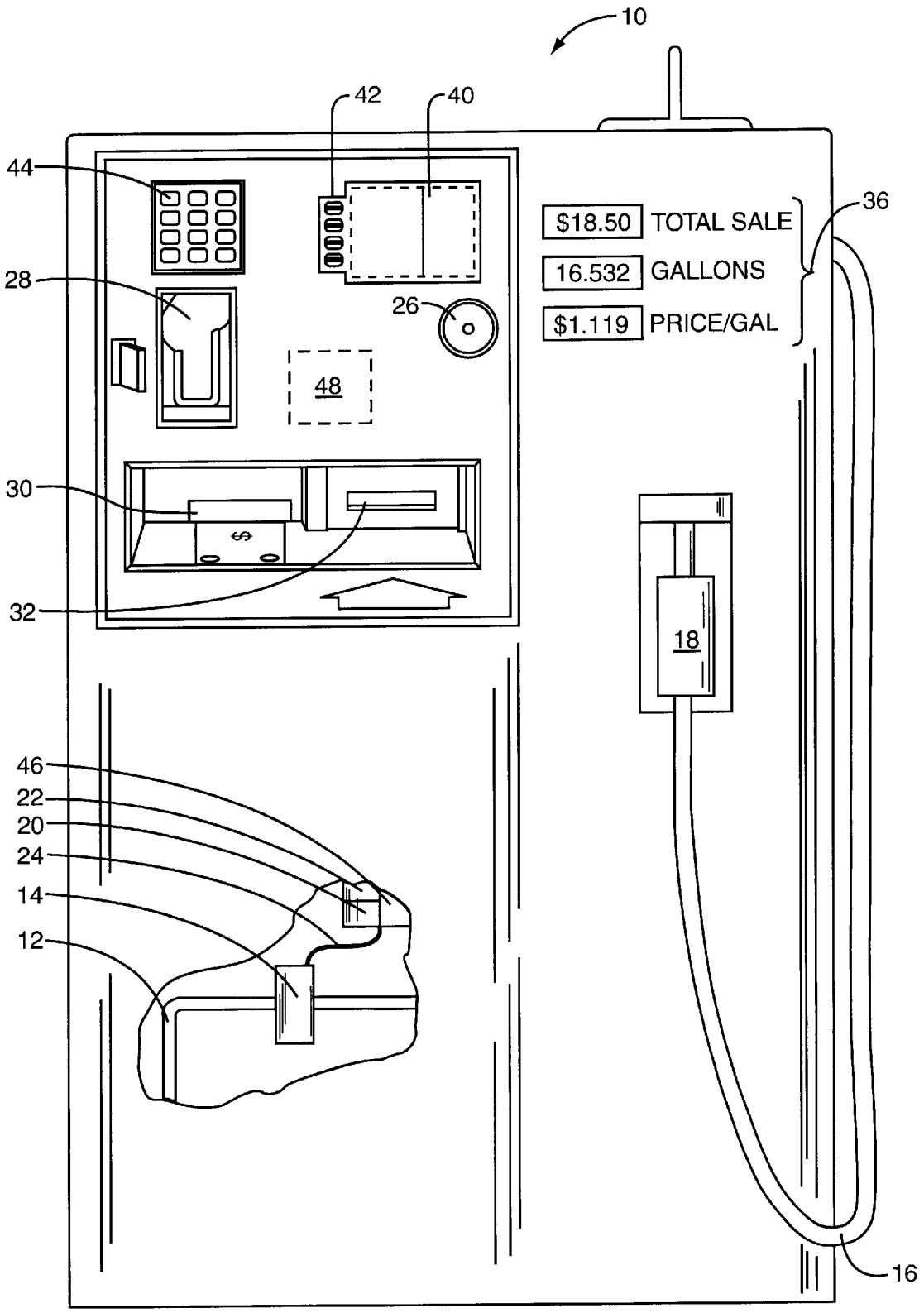
FIG. 1 is a schematic representation of a fuel dispenser constructed according to the present invention.

In the following description, like reference characters designate like or corresponding parts throughout the several figures. It should be understood that the illustrations are for the purpose of describing preferred embodiments of the invention and are not intended to limit the invention thereto.

As best seen in FIG. 1, a fuel dispenser, generally designated 10, is shown constructed according to the present invention. The fuel dispenser provides a fuel delivery path from an underground storage tank to a vehicle (not shown). The delivery path includes a fuel delivery line 12 having a fuel metering device 14. A fuel delivery line 12 communicates with a fuel delivery hose 16 outside of the dispenser 10 and a delivery nozzle 18. The nozzle 18 provides manual control of fuel delivery to the vehicle.

The dispenser 10 generally includes a control system (hereinafter referred to as controller 20) and associated memory 22. The controller 20 may receive volume data from the metering device 14 through cabling 24 as well as provide control of fuel delivery. The controller 20 may provide audible signals to an audio module and speaker 26 in order to provide various beeps, tones and audible messages to an operator. These messages may include warnings, instructions and advertising.

The dispenser 10 may be equipped with a card reader 28 or a cash acceptor 30 and a receipt printer 32. With these options, the dispenser controller 20 may read data from a magnetic strip when a card is inserted in the card reader 28 and communicate to a service-station-based controller, such as the G-site controller sold by Gilbarco, Inc. of Greensboro, N.C. The service station based controller generally communicates with a remote credit card verification authority to ascertain whether a transaction proposed to be charged to or debited from the account associated with the card inserted in the card reader 28 is authorized.

Figure 2:
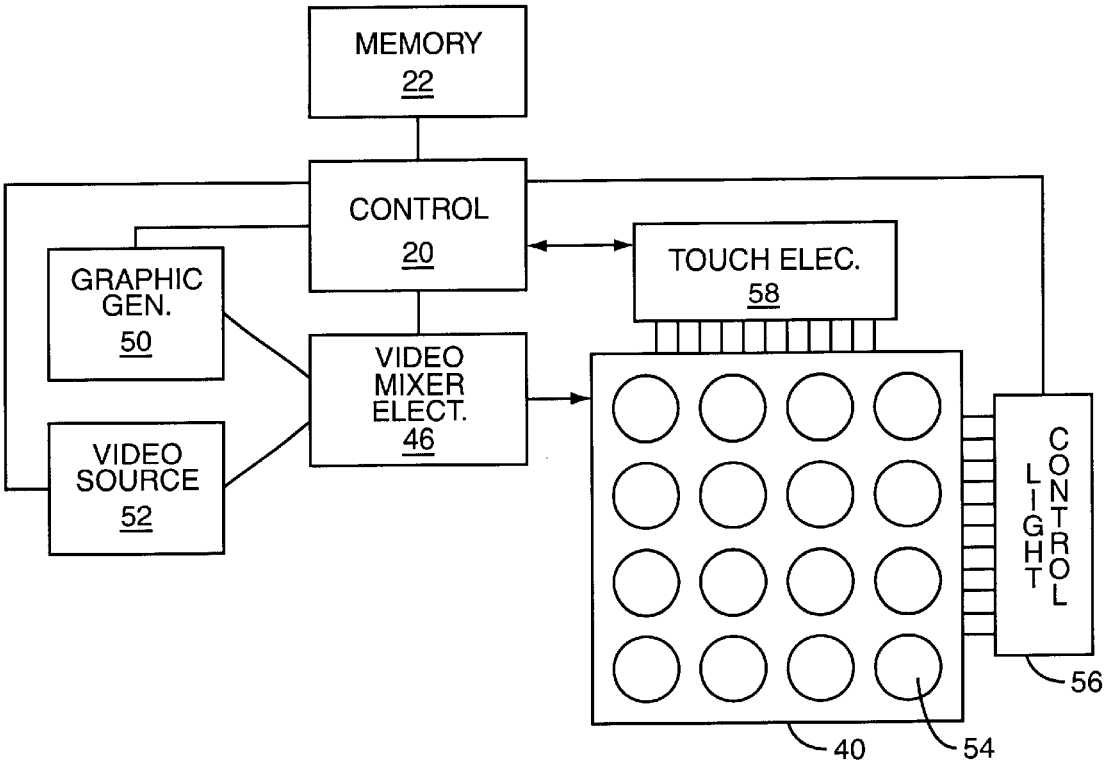
FIG. 2 is a schematic representation of a display and associated dispenser electronics constructed according to the present invention.

The dispenser 10 may also include various types of displays, preferably, one or more alpha numeric displays 36 in addition to a high resolution graphics display 40. Preferably, the graphics display 40 will have an associated graphics display keypad 42 adjacent the display or integrated with the graphics display 40 to provide a touch screen interface. The display will preferably receive video and graphics images from one or more video sources 52 and graphics generator 50 through video mixer and driver electronics 46 (as shown in FIG. 2). The dispenser may have an additional general keypad 44. Notably, the displays 36, 40 and keypads 42, 44 may be integrated into a single device. The controller 20 is desirably comparable to the microprocessor based control systems used in CRIND (card reader in the dispenser) and TRIND (tag or transponder reader in the dispenser) type units sold by Gilbarco, Inc. under the trademark THE ADVANTAGE.

The fuel dispenser will include proximity sensing means adapted to provide a signal to the control system indicating a customer is within (1) a predetermined proximity of the dispenser, (2) a relative proximity with respect to the dispenser, or (3) a relative location with respect to the dispenser. The proximity sensing means may be provided by one or more proximity sensors 48 or a highly sensitive touch screen display configuration, such as display 40.

In the first embodiment, the proximity sensors 48 may be mounted anywhere on or near the fuel dispenser 10 and configured to provide a signal to the controller 20 indicative of the proximity of a customer with respect to the fuel dispenser. In the second embodiment, the touch screen 40 will operate in a highly sensitive mode wherein the display is sensitive to a customer's presence near the display. A customer need not touch the display to alert the control system to his or her presence in this highly sensitive mode.

Once a customer is detected using the proximity sensing means, the controller 20 may operate in several ways including alerting the customer that interaction with the touch screen display is necessary for conducting the fueling operation, exiting out of a power saving mode, altering the graphics or video provided at the display 40, and/or changing the display's viewing angle to optimize customer viewing based on customer location. Although these actions are preferred, the scope of the invention should not be limited thereto. Those of ordinary skill in the art will quickly recognize various dispenser control functions that could be facilitated upon sensing the approach and/or location of a customer relative to a fuel dispenser. For example, audio instructions or a greeting may be provided through the audio module 26.

Referring now to FIG. 2, a schematic for a basic control system and touch screen display is shown. The control system includes controller 20 and memory 22 coupled to the video mixer and driver electronics 46, touch screen electronics 58, and back-lighting control electronics 56. The video mixer and driver electronics are coupled to the graphics generator 50, which provides graphics for display on the touch screen display 40, and the video source 52, which provides running audio and/or video for display. The video source may include, but is not limited to, laser disks, DVD's, the Internet and video cameras. The touch screen electronics 58 typically provide signals to the controller 20 indicative of where the display 40 has been touched in order to differentiate customer inputs and selections.

As noted above, the display 40 and touch screen electronics 58 may be configured to operate in a highly sensitive mode wherein the display and touch screen electronics 58 are able to sense changes in a field emitted from the display 40 without requiring an actual touching of the display. Preferably, this field will extend up to several feet in front of the display over a respective fueling position in front of the dispenser 10.

In the preferred embodiment, the display is a capacitive touch screen display capable of operating at various frequencies to provide various sensitivity levels. Typically, the increased frequencies provide higher sensitivity. An exemplary capacitive touch screen display is manufactured by Microtouch™. This display could sense a customer coming within four (4) feet of the display.

Thus, in the preferred embodiment, the controller 20 could increase the frequency and, therefore, the display's sensitivity between fueling operations in order to sense the approach and/or presence of a customer at the beginning of a new fueling operation.

The controller 20 may be adapted to control display back-lighting 54 through back-lighting control electronics 56. Depending on the application, the back-lighting may be decreased from a nominal operating level or turned completely off between fueling operations, to reduce heat and conserve energy. Preferably, once a customer is detected within a relative proximity to the fuel dispenser, the back-lighting is increased or turned on to the normal operating level in order to make the display content readily visible to the customer as well as draw the customer's attention to the display.

Figure 3:
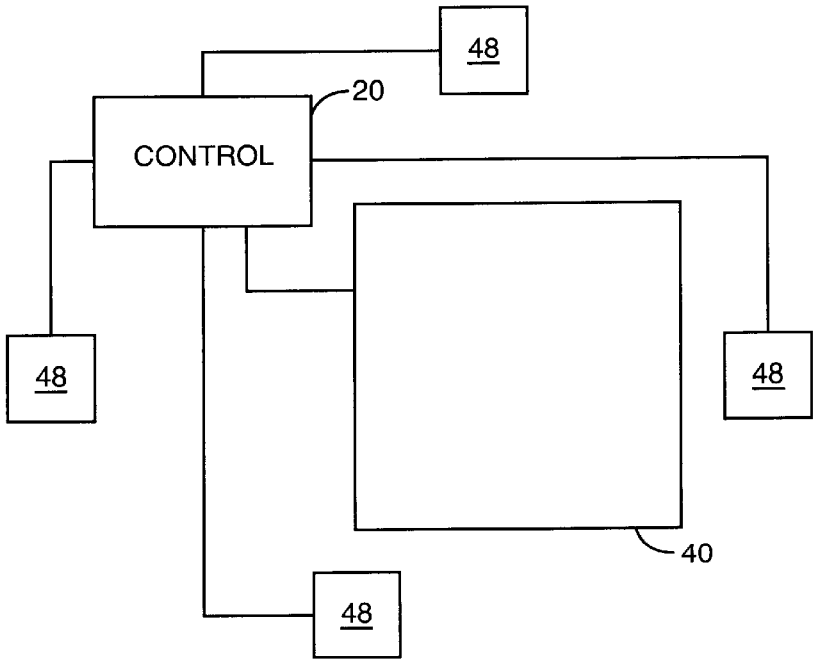
FIG. 3 is a schematic representation of a display associated with plural proximity sensors constructed according to the present invention.

As shown in FIG. 3, the controller 20 may also be coupled to one or more proximity sensors 48 located at various positions in numerous possible configurations about the display 40. These proximity sensors 48 may be used instead of or in addition to a display 40 for sensing proximity. Notably, when multiple proximity sensors 48 are used, the controller 20 may be configured to monitor the relative proximity of a customer measured at each of the proximity sensors 48 to determine a relative location of the customer with respect to the dispenser and display 40. This information may be used to control the viewing angle on an LCD display and/or change fonts or text sizes accordingly to enhance visibility.

For example, if proximity sensors 48 were located on either side of the display 40, the display could be adjusted so that the horizontal viewing angle is properly adjusted. In other words, if a person were standing to the right of the display, the control system would determine that the customer was more proximate to the proximity sensor 48 to the right of the display than to the proximity sensor 48 to the left of the display. The viewing angle of the display could be adjusted accordingly. Likewise, proximity sensors 48 located at the top and bottom of the display may be used to adjust the vertical viewing angle based on the height of the individual. Combining proximity sensors on either side and the top and bottom of the display provides a more enhanced control of viewing angles on both the horizontal and vertical planes.

Figure 4:
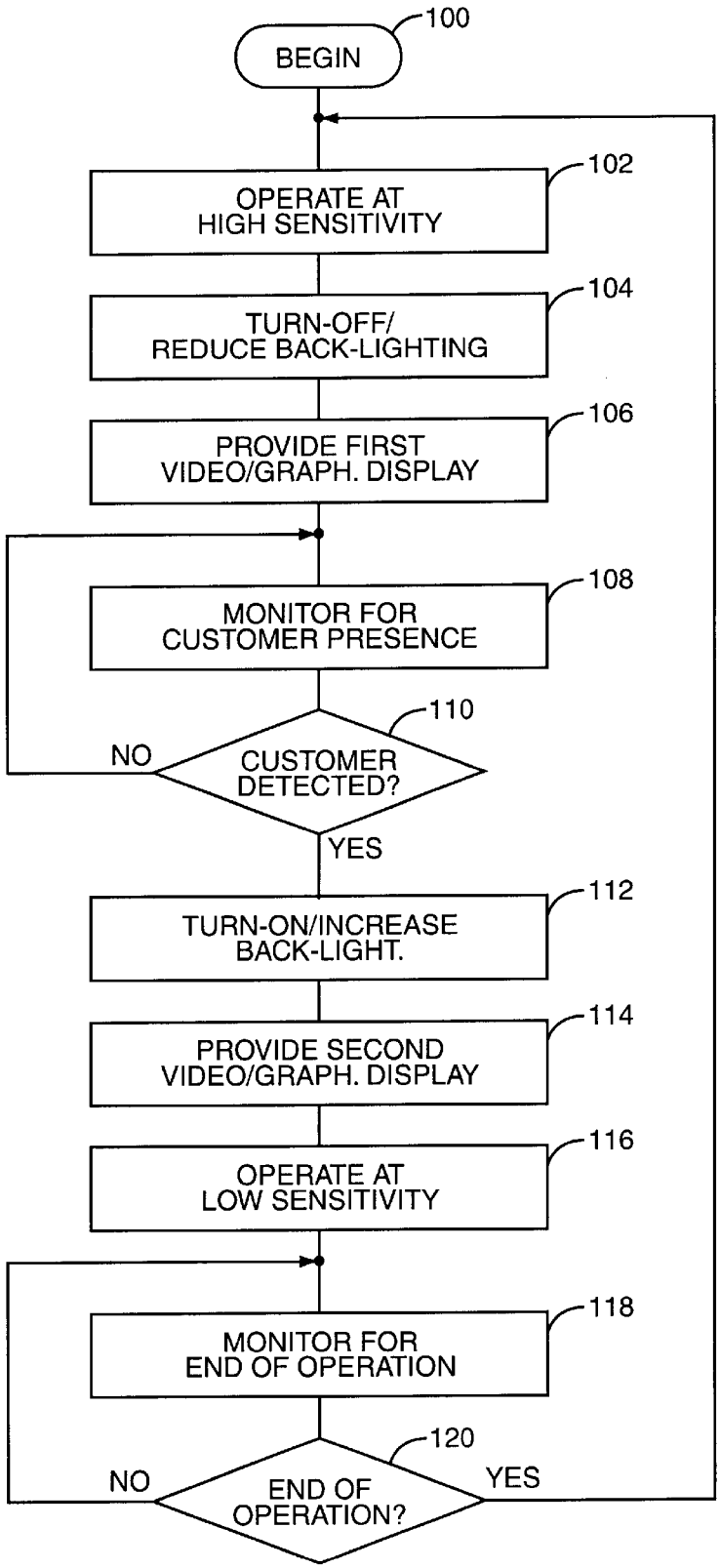
FIG. 4 is a flow chart of a basic process of controlling a display based on proximity of a customer according to the present invention.

As noted, if the dispenser is equipped with a touch screen display 40 capable of operating at a higher sensitivity to detect customer proximity, various control capabilities are available. An exemplary process is shown in FIG. 4. The process begins (block 100) wherein the controller 20 operates the display 40 at a high sensitivity (block 102). The controller 20 will preferably turn off or reduce the back-lighting (block 104) to conserve energy and reduce heat buildup during this period. Alternatively, the controller 20 may provide a first video/graphic display. Preferably, this display occurs during periods between fueling operations (block 106).

The controller 20 will monitor the display 40 and associated touch screen electronics 58 for an indication of a customer's presence (block 108). If a customer is detected (block 110), the controller 20 will turn on or increase the back-lighting to a preferred level (block 112) and/or provide a second video/graphics display (block 114). The second display is preferably adapted to provide instructions or welcoming information corresponding to the beginning or start of a fueling operation. The controller 20 will typically reduce the sensitivity of the display 40 to provide normal touch-sensitive operations (block 116). The fueling operation will continue and the controller 20 will monitor for an end of the fueling operation (block 118). At the end of the fueling operation (block 120), the process begins anew (block 102) wherein the display is operated at a high sensitivity, the back-lighting is reduced or turned off, and the first video/graphics display is provided. The controller 20 will monitor for the presence of a customer to start a new fueling operation.

Figure 5A:
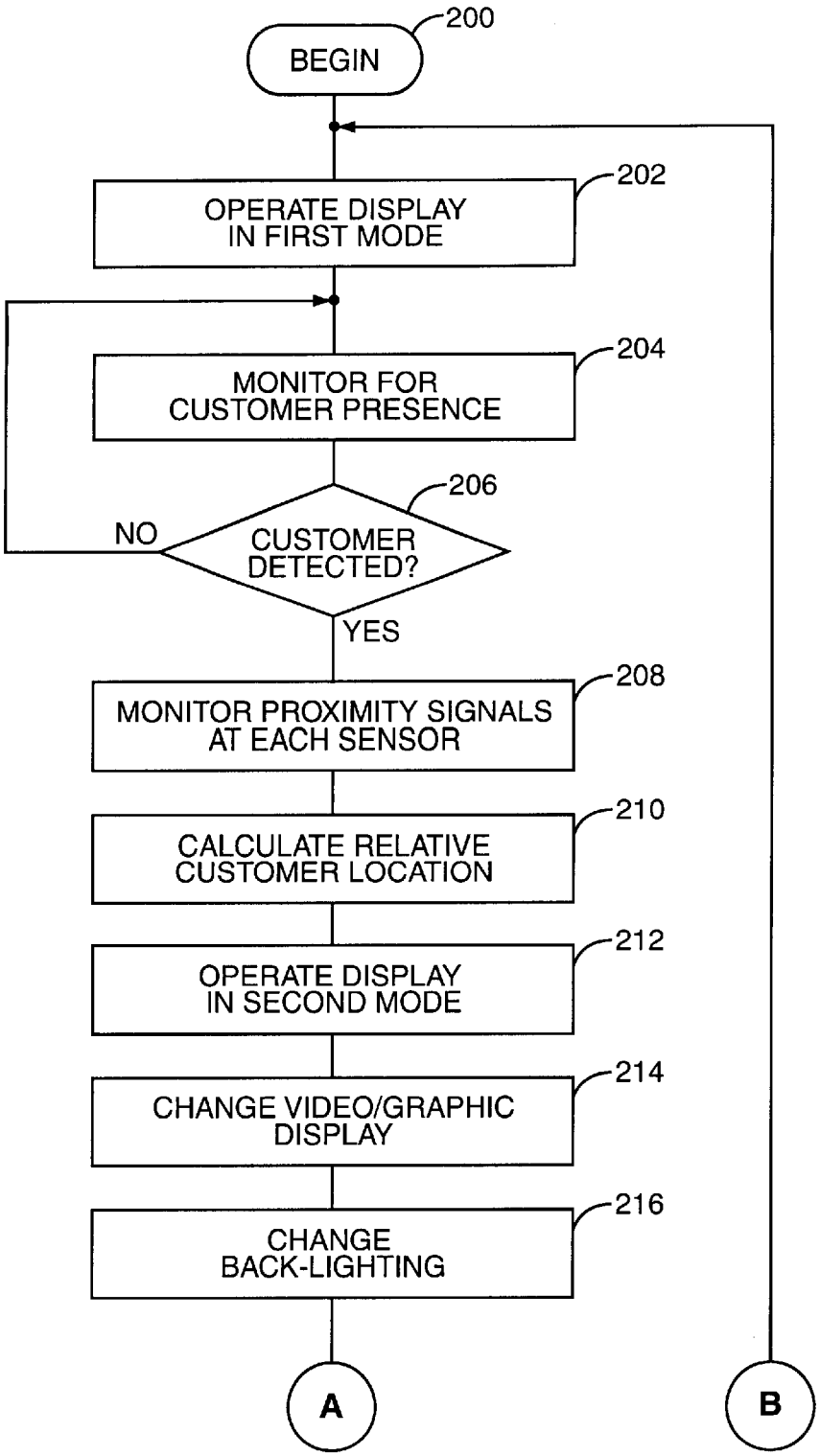
FIGS. 5A and 5B are a flow chart of a basic process of controlling a fuel dispenser display based on proximity and location of a customer according to the present invention.
Figure 5B:
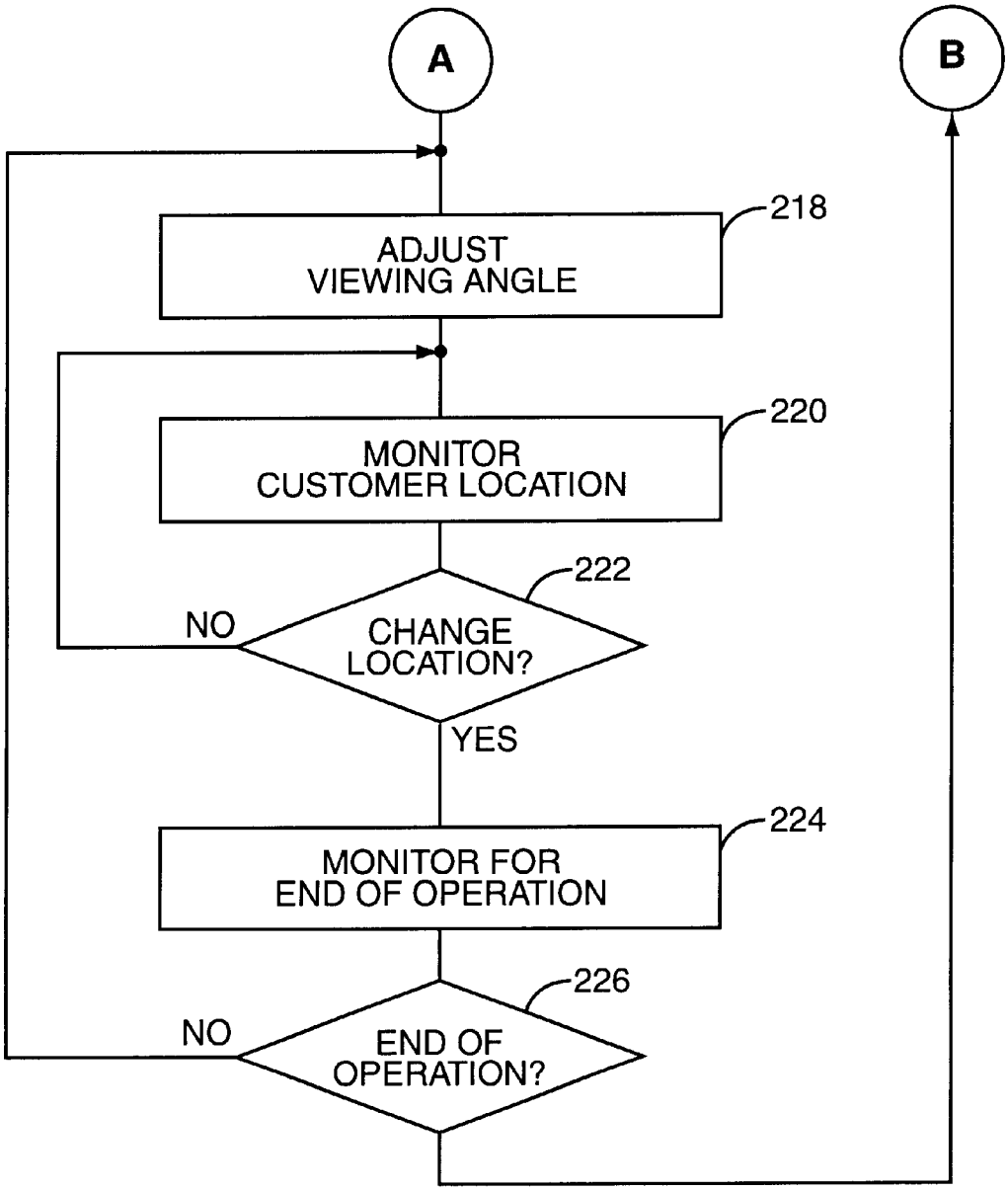

FIGS. 5A and 5B are a flow chart representing the basic process of providing advanced control based on determining the location of a customer relative to the dispenser and/or display. This process typically requires at least two proximity sensors, one of which may be the display 40 operated in a high-sensitivity mode. The Microtouch™ display may control sensitivity by varying the operational frequency.

The process begins (block 200) wherein the display is operated in a first mode. The display mode may relate to the type of information displayed, whether the display is in an active or inactive mode, or whether back-lighting is turned off or decreased from a normal operating level. Typically, the first mode relates to display operation during non-fueling periods.

At this point, the controller 20 monitors for the presence of a customer relative to the fuel dispenser (block 204). Once a customer is detected (block 206), the controller 20 monitors the proximity signals received at each sensor (block 208) and calculates the relative customer location (block 210) based on these proximity signals. Once the customer is detected or determined to be in a certain location, the controller 20 operates the display in a second mode, which typically attracts the attention of a customer, provides instructions or welcoming information, and/or awakens from an inactive mode. The controller 20 may change the video/graphic display (block 214), change back-lighting levels (block 216), and preferably adjust the viewing angle (block 218) based on customer location as discussed above.

The controller 20 will continue to monitor customer location throughout the fueling operation (block 220). If a change in location is detected (block 222), the controller 20 will determine whether the fueling operation is at an end (block 224) and adjust the viewing angle if the operation is not at an end (block 226 and 218). The end of a fueling operation may be determined by sensing the nozzle handle being pulled down, detecting the absence of a detection signal for a select period, or sensing the end of fuel delivery. The modes may include various audio modes instead of, or in addition to, the video modes. For example, once a customer is within a certain proximity, an audible message may be provided alone or in combination with a different display mode.

The present invention provides a fuel dispenser capable of sensing the approach, relative proximity and/or location of a customer relative to the fuel dispenser and controls the fuel dispenser accordingly without requiring customer input. The invention draws customers' attention to the display on approach, provides information to a customer in order to start the fueling operation, reduces heat, saves energy, and reduces the number of components necessary to manufacture dispensers providing high-quality, multimedia displays.

Certain modifications and improvements will occur to those skilled in the art upon reading the foregoing description. It should be understood that all such modifications and improvements have been deleted herein for the sake of conciseness and readability, but are properly within the scope of the following claims.

What is claimed is:

1. A fuel dispenser providing dual mode display control based on customer proximity comprising:

A. a housing and delivery hardware for delivery fuel to a vehicle;

B. a display within said housing having a first and second mode;

C. proximity sensing electronics associated with said housing and adapted to sense proximity of a customer relative to said housing; and D. a control system coupled with said display and said proximity sensing electronics and adapted to operate said display in the first mode when a customer is not relatively proximate to said housing and operate said display in the second mode when a customer is relatively proximate to said housing.

2. The fuel dispenser of claim 1 wherein said first mode for said display is an inactive state and said second mode for said display is an active state.

3. The fuel dispenser of claim 2 wherein said first mode for said display provides a dimmer display and said second mode for said display provides a brighter display.

4. The fuel dispenser of claim 1 wherein said display is a liquid crystal display with back-lighting, said control system being adapted operate said backlighting at a reduced level in said first mode and at an increased level in said second mode.

5. The fuel dispenser of claim 1 wherein said control system provides a first display on said display in said first mode and a second display on said display in said second mode.

6. The fuel dispenser of claim 5 wherein said first display is a non-transaction display and said graphic display is a pre-transaction display.

7. The fuel dispenser of claim 6 wherein said non-transaction display provides general display content and said pre-transaction display provides content aiding the customer in beginning a transaction.

8. The fuel dispenser of claim 6 wherein said non-transaction display provides general display content and said pre-transaction display provides instruction aiding the customer in beginning a transaction.

9. The fuel dispenser of claim 6 wherein said non-transaction display provides general display content and said pre-transaction display provides content welcoming the customer.

10. The fuel dispenser of claim 5 wherein said control system is associated with a video source for generating video information on said display.

11. The fuel dispenser of claim 5 wherein said control system is associated with a graphics generator for generating graphics for display on said display.

12. The fuel dispenser of claim 5 wherein said control system is associated with a video source for generating video information on said display and a graphics generator for generating graphics for display on said display wherein said control system controls display of video and graphics on said display.

13. The fuel dispenser of claim 1 wherein said display includes a touch screen display, said display configured to sense a customer proximate said display in said first mode and sense touching a particular point on said display in said second mode wherein said display will operate in a highly sensitive mode to sense a customer relatively proximate to said display and operate in a less sensitive mode to provide a touch screen display in said second mode, said touch screen display providing said touch screen electronics.

14. The fuel dispenser of claim 1 wherein said proximity sensing electronics includes at least one proximity sensor coupled to said control system, said sensor adapted to provide a signal to said control system when the customer becomes relatively proximate to said housing, said control system adapted to change from said first to said second display mode when the customer becomes relatively proximate to said housing.

15. The fuel dispenser of claim 1 wherein said proximity sensing electronics includes at least two proximity sensors coupled to said control system to provide signals to said control system when the customer becomes relatively proximate to said housing, said control system adapted to monitor said signals to change from said first to said second display mode when the customer becomes relatively proximate to said housing.

16. The fuel dispenser of claim 15 wherein said control system compares said signals from said proximity sensors to determine a location of the customer relative to said housing.

17. The fuel dispenser of claim 15 wherein said control system compares said signals from said proximity sensors to determine a location of the customer relative to said display on said housing.

18. The fuel dispenser of claim 1 wherein said proximity sensing electronics includes at least two proximity sensors coupled to said control system to provide signals to said control system when the customer becomes relatively proximate to said housing, said control system adapted to monitor said signals to determine a location of the customer relative to said display and select said display mode according to customer location.

19. The fuel dispenser of claim 18 wherein said first display mode is operated to optimize viewing at first viewing angle and said second display mode is operated to optimize viewing at a second viewing angle.

20. The fuel dispenser of claim 19 wherein said sensors are placed proximate to said display on said housing.

21. The fuel dispenser of claim 20 wherein at least one said sensor is placed proximate each side of said display.

22. The fuel dispenser of claim 20 wherein at least one said sensor is placed proximate a top and bottom of said display.

23. The fuel dispenser of claim 20 wherein at least one said sensor is placed proximate each side, top and bottom of said display.

24. The fuel dispenser of claim 1 wherein said first mode is an energy conservation mode and said control system operates said display in said first mode when a customer is not proximate said housing and in said second mode when a customer is relatively proximate said housing.

25. The fuel dispenser of claim 1 wherein said display displays text, said text having a text point size being one size in said first mode and a larger size in said second mode.

26. A method of operating a dispenser display in two modes comprising:

A. operating a fuel dispenser display in a first mode;

B. sensing a customer proximate a fuel dispenser without requiring customer contact with the dispenser or display; and C. operating the fuel dispenser display in a second mode upon sensing the customer proximate the fuel dispenser.

27. The method of claim 26 wherein the first operating step includes displaying a first display on the display and the second operating step includes displaying a second display on the display.

28. The method of claim 27 wherein the first display includes a nontransaction display and the second display facilitates a start of a fueling operation.

29. The method of claim 26 wherein the first operating step includes operating the display in a dim mode and the second operating step includes operating the display in a bright mode.

30. The method of claim 26 wherein the first operating step includes operating the display in an inactive state and the second operating step includes operating the display in an active state.

31. The method of claim 26 wherein the first operating step includes operating back-lighting of the display at a reduced level and the second operating step includes operating the back-lighting of the display at an increased level.

32. The method of claim 26 wherein the sensing step includes sensing customer proximity using said display.

33. A method of operating a dispenser display in two modes comprising:

A. sensing a customer proximate a fuel dispenser without requiring customer contact;

B. determining a location of the customer relative to the fuel dispenser;

C. operating a fuel dispenser display in a first mode if the customer is at a first location; and D. operating the fuel dispenser display in a second mode if the customer is at a second location.

34. The method of claim 33 wherein the first operating step includes operating the display to optimize the viewing angle for the first location for the first mode and the second operating step includes operating the display to optimize the viewing angle for the second location for the second mode.

35. A fuel dispenser controlled according to customer proximity comprising:

A. a housing and fuel delivery electronics;

B. a proximity sensor; and

C. a display associated with said proximity sensor and said housing;

D. said display adapted to change from a first mode to a second mode upon said proximity sensor sensing a customer proximate said housing without direct customer contact.

36. The fuel dispenser of claim 35 wherein said proximity sensing means is a touch screen display adapted to operate in a high sensitivity mode capable of sensing a customer proximate said display without direct customer contact in said first mode and a normal sensitivity mode for touch screen functions in said second mode.

37. A customer interaction device providing dual mode control based on customer proximity comprising:

A. a housing;

B. a display in said housing;

C. proximity sensing electronics associated with said housing and adapted to sense proximity of a customer relative to said housing; and D. a control system coupled with said display and said proximity sensing electronics and adapted to operate said customer interaction device in a first mode when a customer is not relatively proximate to said housing and operate said customer interaction device in a second mode when a customer is relatively proximate to said housing.

38. The customer interaction device of claim 37 wherein said first mode is a first display mode and said second mode is a second display mode.

39. The customer interaction device of claim 37 further comprising an audio system and wherein said second mode includes providing audible information through said audio system.

40. A method of operating a dispenser in two modes comprising:

A. operating a fuel dispenser display in a first mode;

B. sensing a customer proximate a fuel dispenser without requiring customer contact; and C. operating the fuel dispenser display in a second mode upon sensing the customer proximate the fuel dispenser.

41. The method of claim 40 wherein the second operating step includes providing audio information to the customer.

* * * * *